US007865967B2

(12) United States Patent
Van Winkle et al.

(10) Patent No.: US 7,865,967 B2
(45) Date of Patent: Jan. 11, 2011

(54) BODY ARMOR

(76) Inventors: Christopher Sean Van Winkle, 417 Jamestown Ave., Fayetteville, NC (US) 28303; David Alan Cox, 116 Proclamation Dr., Raeford, NC (US) 28376

( * ) Notice: Subject to any disclaimer, the term of this patent is extended or adjusted under 35 U.S.C. 154(b) by 272 days.

(21) Appl. No.: 11/457,983

(22) Filed: Jul. 17, 2006

(65) Prior Publication Data

US 2010/0313320 A1 Dec. 16, 2010

Related U.S. Application Data

(63) Continuation of application No. 11/027,281, filed on Dec. 30, 2004, now Pat. No. 7,076,806.

(51) Int. Cl.
*F41H 1/02* (2006.01)

(52) U.S. Cl. ..... 2/2.5; 2/102

(58) Field of Classification Search ..... 2/2.5, 2/102, 94, 96, 97, 464, 467; 89/36.01, 36.02, 89/36.05; 428/911
See application file for complete search history.

(56) References Cited

U.S. PATENT DOCUMENTS 1,269,019 A * 6/1918 Szmyt ..... 2/2.5
1,739,112 A 12/1929 Wisbrod
2,748,391 A 6/1956 Lewis, Jr. et al.
2,755,475 A 7/1956 Lipshitz
3,331,083 A 7/1967 Holly
3,514,786 A 6/1970 Terwilliger
3,577,836 A * 5/1971 Tamura ..... 2/2.5
4,384,369 A 5/1983 Prince
4,425,667 A 1/1984 Harrison
4,485,492 A 12/1984 Sneider
4,497,069 A 2/1985 Braunhut
4,660,223 A 4/1987 Fritch
4,680,813 A 7/1987 Glaeser
4,783,853 A * 11/1988 Zuber ..... 2/456

(Continued)

FOREIGN PATENT DOCUMENTS

FR 2699265 A1 6/1994

(Continued)

OTHER PUBLICATIONS

Selection and Application Guide to Personal Body Armor, U.S. Dept. of Justice, Nov. 2001, pp. 1-123, National Institute of Justice's National Law Enforcement & Corrections Tech.

(Continued)

*Primary Examiner*—Tejash Patel
(74) *Attorney, Agent, or Firm*—Womble Carlyle Sandridge & Rice, PLLC

(57) ABSTRACT

A body armor accessory adds protection to unguarded areas of conventional body armor. The removable accessory comprises an axillary panel having a coverage area and is made of material that impedes the penetration of a foreign object. The accessory can be worn on either the left or right side of the wearer. The coverage area to the deltoid and flank areas of the wearer provided by the axillary panel is greater than that provided by the vest without the panel. A deltoid panel provides added protection to the deltoid area of the wearer.

28 Claims, 7 Drawing Sheets

U.S. PATENT DOCUMENTS

| | | | | |
|---|---|---|---|---|
| 4,864,656 | A | 9/1989 | Nesse | |
| 4,870,706 | A | 10/1989 | Ketcham et al. | |
| 4,993,076 | A | 2/1991 | Dierickx | |
| 5,044,011 | A | 9/1991 | Henderson | |
| 5,060,314 | A | 10/1991 | Lewis | |
| 5,072,453 | A | 12/1991 | Widder | |
| 5,157,792 | A | 10/1992 | Allen et al. | |
| 5,327,811 | A | 7/1994 | Price et al. | |
| 5,487,187 | A | 1/1996 | Zide et al. | |
| 5,495,620 | A | 3/1996 | Schoenweiss et al. | |
| 5,584,737 | A | 12/1996 | Luhtala | |
| 5,623,729 | A | 4/1997 | Chen | |
| 5,966,747 | A | 10/1999 | Crupi et al. | |
| 5,970,513 | A | 10/1999 | Kocher | |
| 6,026,510 | A | 2/2000 | Kocher | |
| 6,029,270 | A | 2/2000 | Ost et al. | |
| 6,098,196 | A | 8/2000 | Logan | |
| 6,108,813 | A | 8/2000 | Tolliver et al. | |
| 6,162,746 | A * | 12/2000 | Chiou | 442/134 |
| 6,446,273 | B1 | 9/2002 | Gillen et al. | |
| 6,453,791 | B1 | 9/2002 | Sceitzinger | |
| 6,532,857 | B1 | 3/2003 | Shih et al. | |
| 6,698,024 | B2 | 3/2004 | Graves et al. | |
| 6,745,661 | B1 | 6/2004 | Neal et al. | |
| 7,076,806 | B1 * | 7/2006 | Van Winkle et al. | 2/2.5 |
| 7,266,850 | B1 * | 9/2007 | Strum et al. | 2/2.5 |
| 2004/0177425 | A1 | 9/2004 | Kerr | |
| 2005/0266748 | A1 | 12/2005 | Wagner et al. | |
| 2006/0234577 | A1 | 10/2006 | Wagner et al. | |
| 2008/0098500 | A1 | 5/2008 | Matic et al. | |

FOREIGN PATENT DOCUMENTS

WO WO 2006/083395 A2 8/2006

OTHER PUBLICATIONS

Definition of "Pauldron" and "Pouldron", The Oxford English Dictionary, 1989, pp. 1-4, Second Edition, vol. XII, Clarendon Press—Oxford.
Britsh & Continental Arms and Armour, Charles Henry Ashdown, 1970, pp. 1-17, Dover Publications, Inc., New York.
Arming Doublet 1400s, Higgins Armory Museum—online, 1972, p. 1, Blair.
Battle Armor Full Body, NexTag Comparison Shopping—online, Dec. 5, 2007, p. 1.
Chainmail Shirt, Medieval-chain-mail-armor.com, pp. 1-3.
Armor Innovations Enhance Safety, The Fayetteville Observer, Kevin Maurer, Feb. 29, 2004, pp. 1-2, Vo. CLXXXVII-No. 162, North Carolina Newspaper.
GI Innovation Saves Lives, The Canopy, Feb. 7, 2004, p. 3, vol. 2, Issue 6, 82nd Airborne Division Public Affairs Office & 350th Mobile Public Affiars Detachment.
Researchers, Manufacturers Search for Better Body Armor, National Defense Magazine Article, Joe Pappalardo, Aug. 2004, pp. 1-3, National Defense Industrial Association.
Marine Lethal Torso Injuries: Preliminary Findings, Armed Forces Institute of Pathology, Office of the Armed Forces Medical Examiner, Feb. 28, 2005, pp. 1-4.
Photograph, www.us.army.mil.com, Army Knowledge Online Home Page, known on or about Dec. 8, 2004, p. 1.
The besague, Armor Design, The Armor Construction and Heraldry Site, 2003, pp. 1-10.
Complaint, United States Court of Federal Claims, *Christopher Sean Van Winkle* v. *The United States*, No. 07-652C, pp. 1-19.
Answer to Compliant, United States Court of Federal Claims, *Christopher Sean Van Winkle* v. *The United States*, No. 07-652C, pp. 1-19.
Proposed Third Party Defendant's Answer to the Complaint, United States Court of Federal Claims, *Christopher Sean Van Winkle* v. *The United States*, No. 07-652C, pp. 1-15.
Personal Protective Equipment, Jane's Explosive Ordnance Disposal, Pentagon Library, 2002-2003, pp. 1-3, Second Edition, Edited by Colin King and Joanne King.
James R. Burbett, Venable LLP, Request for Ex Parte Reexamination, In Re: Patent No. 7,076,806, Issue Date: Jul. 18, 2006, US Patent and Trademark Office, Jun. 30, 2008, pp. 1-120.
International Search Rprt & Written Opinion, Jul. 18, 2008, pp. 1-8, Intrn Appl # PCT/US05/46912, International Searching Authority.
Stipulation for the Entry of Judgment, United States Court of Federal Claims, *Christopher Sean Van Winkle* v. *The United States*, No. 07-652C, pp. 1-16, Sep. 4, 2008.
Granted Order, Stipulation for the Entry of Judgment, United States Court of Federal Claims, *Christopher Sean Van Winkle* v. *The United States*, No. 07-652C 1 page, Sep. 9, 2008.
Order, Granted Order, Stipulation for the Entry of Judgment, United States Court of Federal Claims, *Christopher Sean Van Winkle* v. *The United States*, No. 07-652C, 1 page, Sep. 9, 2008.
Judgment, Granted Order, Stipulation for the Entry of Judgment, United States Court of Federal Claims, *Christopher Sean Van Winkle* v. *The United States*, No. 07-652C, 1 page, Sep. 11, 2008.
Decision on Appeal from Government Employees Rights Determination, United States Department of Commerce before the Under Secretary of Technology, *Christopher S. Van Winkle and David A. Cox* v. *Department of the Army*, pp. 1-11, Mar. 20, 2007.
Reexam Response to Final Rejection (U.S. Appl. No. 90/009,210) pp. 1-7, Jun. 19, 2009.
Reexam—Final Rejection (U.S. Appl. No. 90/009,210) pp. 1-17, May 6, 2009.
Amendment and Request for Reconsideration—After Non-final Rejection (U.S. Appl. No. 90/009,210) pp. 1-31, Apr. 10, 2009.
Reexam—Non Final Action (U.S. Appl. No. 90/009,210) pp. 1-11, Feb. 10, 2009.
Reexam—Advisory Action (U.S. Appl. No. 90/009,210) pp. 1-4, Jun. 25, 2009.
Order Granting/Denying Request for Ex Parte Reexamination , Pat. No. 7,076,806, U.S. Patent and Trademark Office, Jul. 19, 2008, pp. 1-16.
Amendment After Final Rejection (U.S. Appl. No. 90/009,210) pp. 1-20 (Dec. 31, 2009).
Ex Parte Reexamination Advisory Action Before the Filing of an Appeal Brief (U.S. Appl. No. 90/009,210) pp. 1-4 (Jan. 12, 2010).
Notice of Appeal (U.S. Appl. No. 90/009,210) pp. 1-3 (Feb. 4, 2010).
Appeal Brief (U.S. Appl. No. 90/009,210) 127 pages (Apr. 5, 2010).
Petition to the Director under 37 CFR 1.181 (U.S. Appl. No. 90/009,210) pp. 1-13, (Jul. 15, 2009).
Amendment; Second David Cox Declaration under 37 CFR 1.132 and supporting Exhibits A1-K (U.S. Appl. No. 90/009,210) pp. 1-93 (Aug. 6, 2009).
Notice of Appeal (U.S. Appl. No. 90/009,210) pp. 1-06, (Aug. 6, 2009).
Decision on Petition under 37 CFR 1.181 (U.S. Appl. No. 90/009,210) pp. 1-05, (Aug. 20, 2009).
Supplemental Response (U.S. Appl. No. 90/009,210) pp. 1-05, (Sep. 18, 2009).
Reexam Final Rejection (U.S. Appl. No. 90/009,210) pp. 1-27 (Nov. 4, 2009).
Reply Brief (U.S. Appl. No). pp. 1-9, Sep. 20, 2010.
Request for Oral Hearing (U.S. Appl. No. 90/009,210) pp. 1-2, Sep. 20, 2010.

* cited by examiner

BODY ARMOR

RELATED APPLICATIONS

This application is a continuation of application Ser. No. 11/027,281, filed Dec. 30, 2004, which is hereby incorporated by reference.

FIELD OF THE INVENTION

This invention relates to body armor, and more specifically to improvements to protection for the axillary and other vulnerable regions of the body.

BACKGROUND

Body armor has been used for centuries to protect areas of the body vulnerable to combative blows and projectiles. While the armor is intended to minimize injuries and fatalities that would otherwise result from such harmful events, the armor must also not interfere with the wearer's ability to carry out his duties with sufficient mobility and dexterity as may be required.

Traditionally body armor has been designed to assist in surviving attacks of known direction and source. For example, the Interceptor Multi-Threat Body Armor System went into production in 1999 and is made by Point Blank Body Armor of Oakland Park, Fla. The Interceptor, among other things, seeks to protect the major body organs from projectiles originating from sources in front or behind the wearer.

Threats to individual soldiers are developing from non-traditional sources. Improvised Explosive Devices (IEDs) often are called "homemade" devices that are designed to cause death or injury primarily by use of explosives. IEDs can be produced in varying sizes, functioning methods, containers, and delivery methods. IEDs can utilize homemade explosives, or military ordnance and ordnance components. In the current conflict in Iraq, IEDs are accounting for a significant percentage of trauma cases and resulting causalities to coalition forces. The methods to counteract IEDs include eliminating the insurgents or terrorists that create the IEDs, improving the means for detecting and eliminating IEDs prior to detonation, altering the environment where IEDS may be located by, for example, increasing the armor protection of vehicles that may encounter IEDs, and improving the body armor that exposed individuals may wear.

Improvements to the body armor would minimize the effects of IEDs that may detonate, in spite of efforts to eliminate their creation. Injuries from IEDs can occur to the axillary, flank and deltoid body regions. Current body armor designs do not protect these exposed areas sufficiently to minimize the harm caused by IEDs and other threats. There is a need therefore for improved body armor that will protect exposed and vulnerable areas of the body from IEDs and other injury-causing projectiles, while retaining the requisite degree of mobility and dexterity that may be required.

SUMMARY OF THE INVENTION

In accordance with a preferred embodiment of this invention, a removable body armor accessory adds protection to areas that conventional body armor leaves substantially unprotected. The accessory comprises an axillary panel having a coverage area and is made of material that impedes the penetration of a foreign object. The coverage area to the deltoid and flank areas of the wearer provided by the axillary panel is greater than that provided by the vest without the panel. A deltoid panel provides added protection to the deltoid area of the wearer. Both panels can be worn on either the left or right side of the wearer.

These and other aspects of the present invention will become apparent to those skilled in the art after a reading of the following description of the preferred embodiments, when considered in conjunction with the drawings. It should be understood that both the foregoing general description and the following detailed description are exemplary and explanatory only and are not restrictive of the invention as claimed.

DETAILED DESCRIPTION

Figure 1:
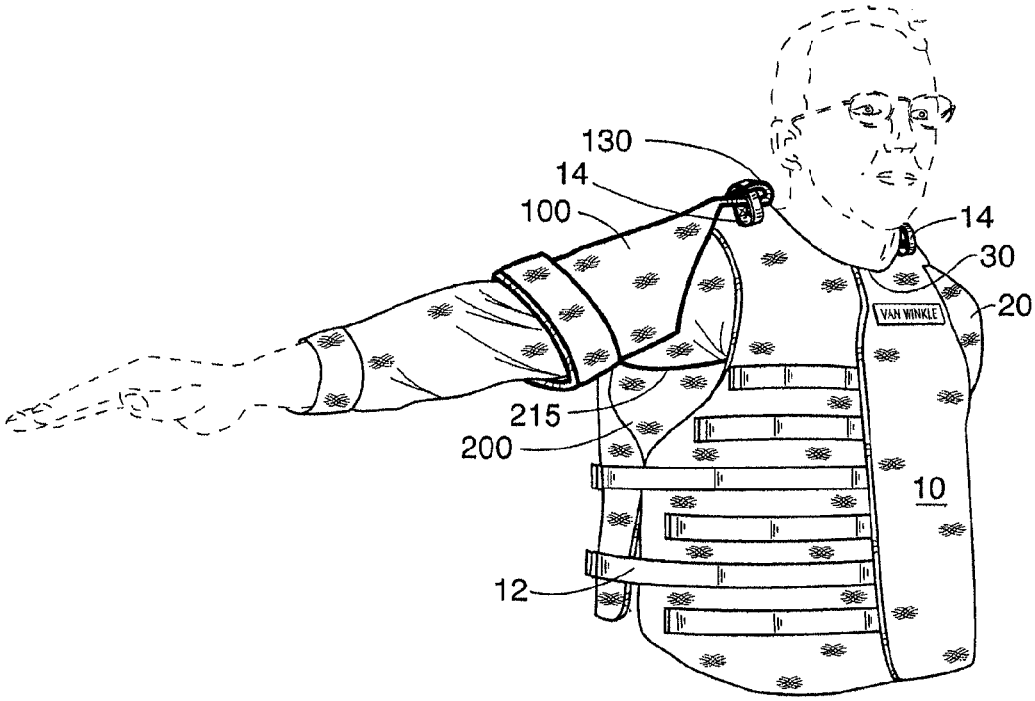
FIG. 1 shows a perspective view of a body armor.
Figure 2:
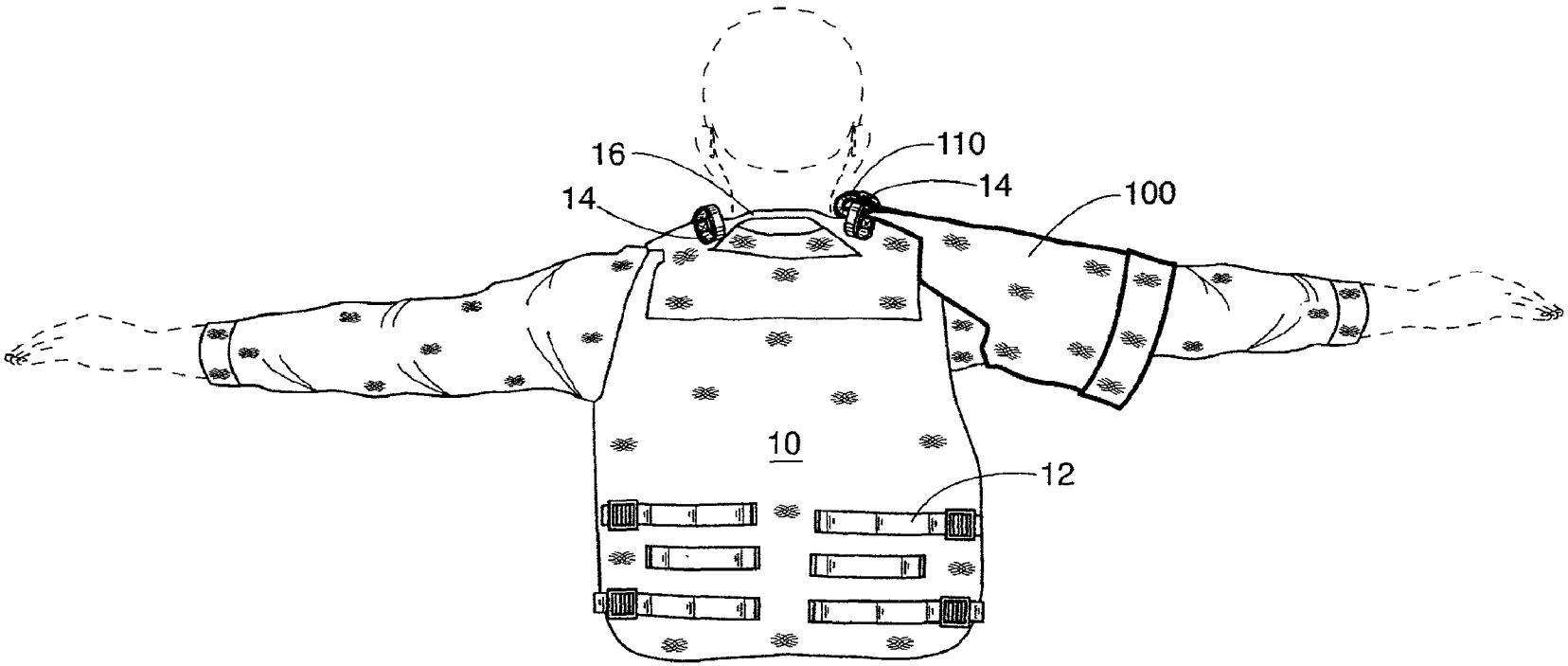
FIG. 2 shows a rear view of a body armor, with the wearer's arms in the outward, horizontal position.

The body armor of this invention is shown and described in preferred embodiments in the description below.

As shown in FIGS. 1, 3, 2, 6A and 6B, traditional body armor can comprise a Kevlar®-lined or other appropriated outfitted vest 10. One such vest, known as the Interceptor Multi-Threat Body Armor System, is made up of two main modular components: the outer tactical vest 10 and the small-arms protective inserts (not shown). The inserts provide for additional protection, and fit within pockets (not shown) affixed to the vest 10. The vest has arm holes 20 and a neck opening 30. A plurality of loops and fasteners, such as shoulder loops 14 and interior loops 24, can be provided for the attachment of various gear and equipment. A modular load bearing webbing system 12 can be included, as well as an emergency extraction strap 16. Optional throat/neck and groin protectors (not shown) also are available. The Interceptor and other traditional body armor provide protection to anterior and posterior directed projectiles, and are credited with saving countless lives.

In embodiments of this invention, deltoid and axillary protector (DAP™) devices are provided that augment the traditional body armor by providing protection to previously under-protected areas of the body. The embodiment can consist of two modular panels or components; namely, a deltoid panel 100 and an axillary panel 200. These panels provide protection but still allow the wearer free use of their arms and torso. Both panels preferably are made of soft, pliable materials capable of conforming to the natural shape of a wearer's shoulder and axillary regions. The panels also can be adaptable for wearing on the left or right side of the wearer.

Figure 4:
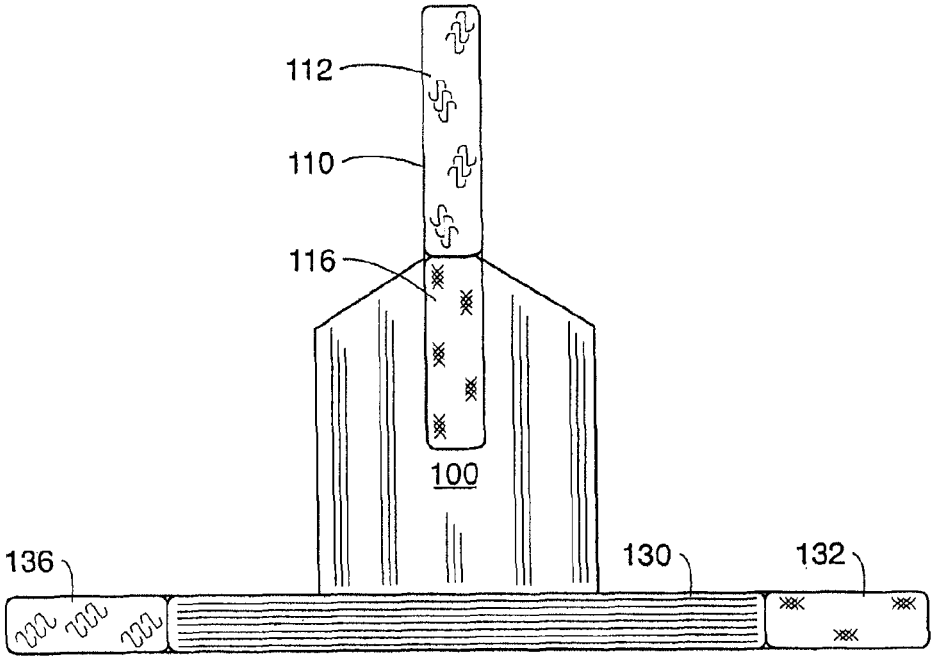
FIG. 4 is a deltoid panel.
Figure 5:
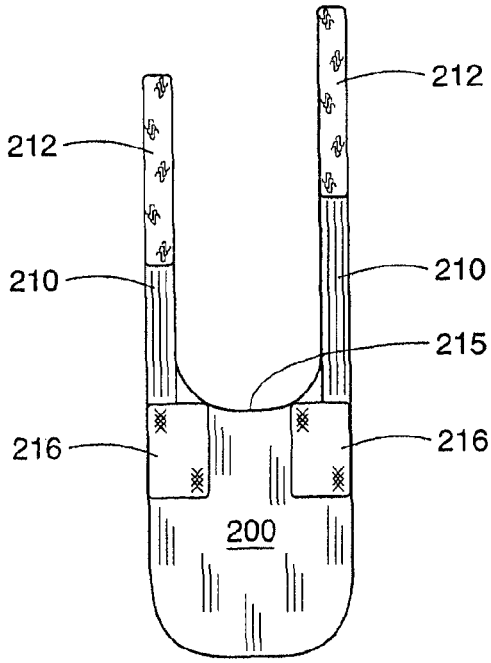
FIG. 5 is an axillary panel.

As shown in FIG. 4, the deltoid panel 100 can help protect the shoulder area from blast fragments and other foreign objects. The deltoid panel 100 is attached to the wearer's vest by way of any suitable connector. In an embodiment, the panel 100 is attached to the vest by attaching the strap 110 to the shoulder epaulet or shoulder loops 14 and by securing the strap 130 to the wearer's upper arm. The deltoid panel 100 attaches to the vest 10 by attaching the strap 110 to the vest by any suitable means. Preferably, strap 110 is routed through the outer shoulder loop 14 of the vest 10, and then secures to itself as shown in FIG. 1. Hook and loop fasteners, e.g., Velcro®, can be used, in positions 112 and 116, respectively, on the strap to also allow for various positioning and self-tightening upon the shoulder of the wearer.

Figure 6A:
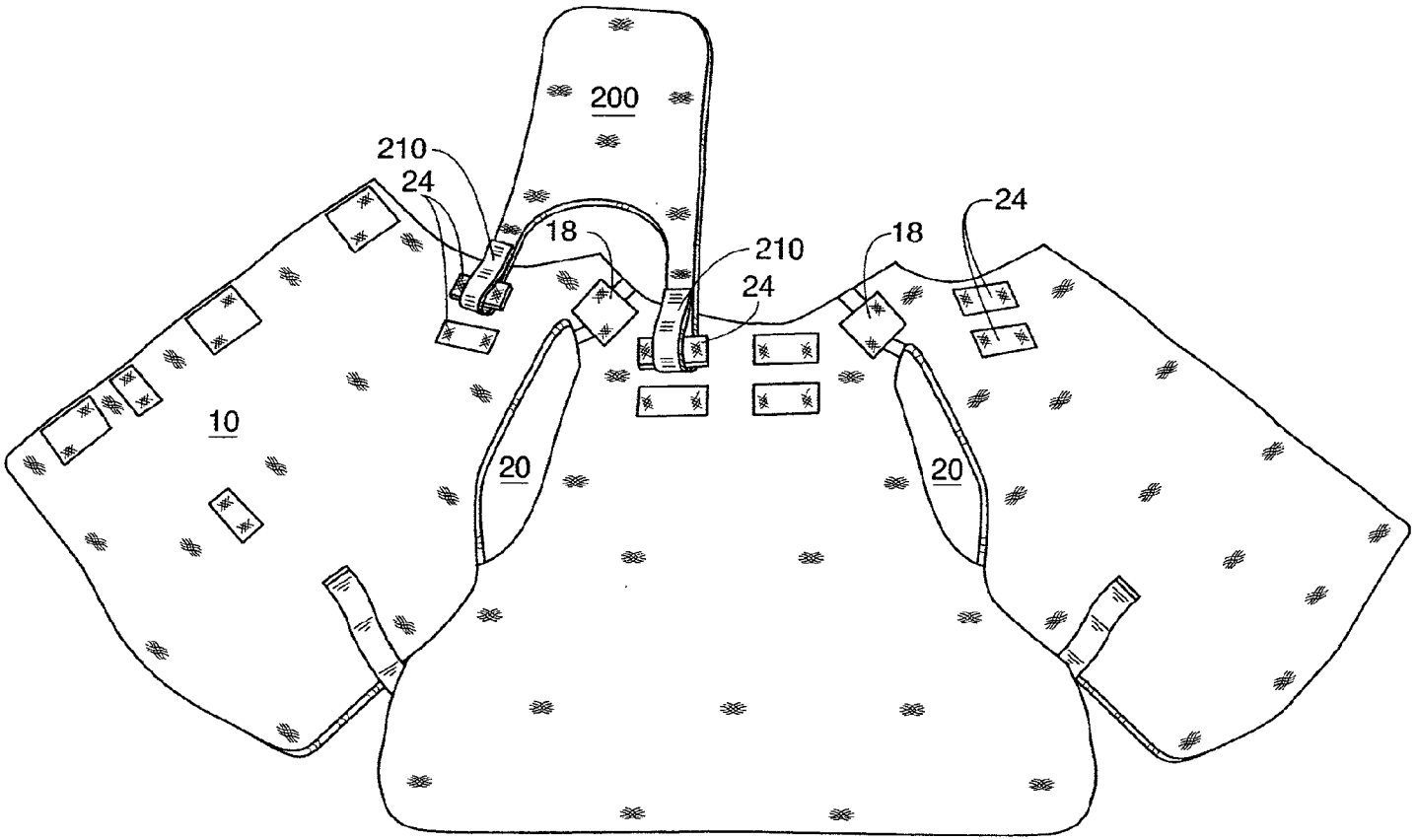
FIGS. 6A and 6B show a body armor vest in an open position, with accessory panels attached thereto.
Figure 6B:
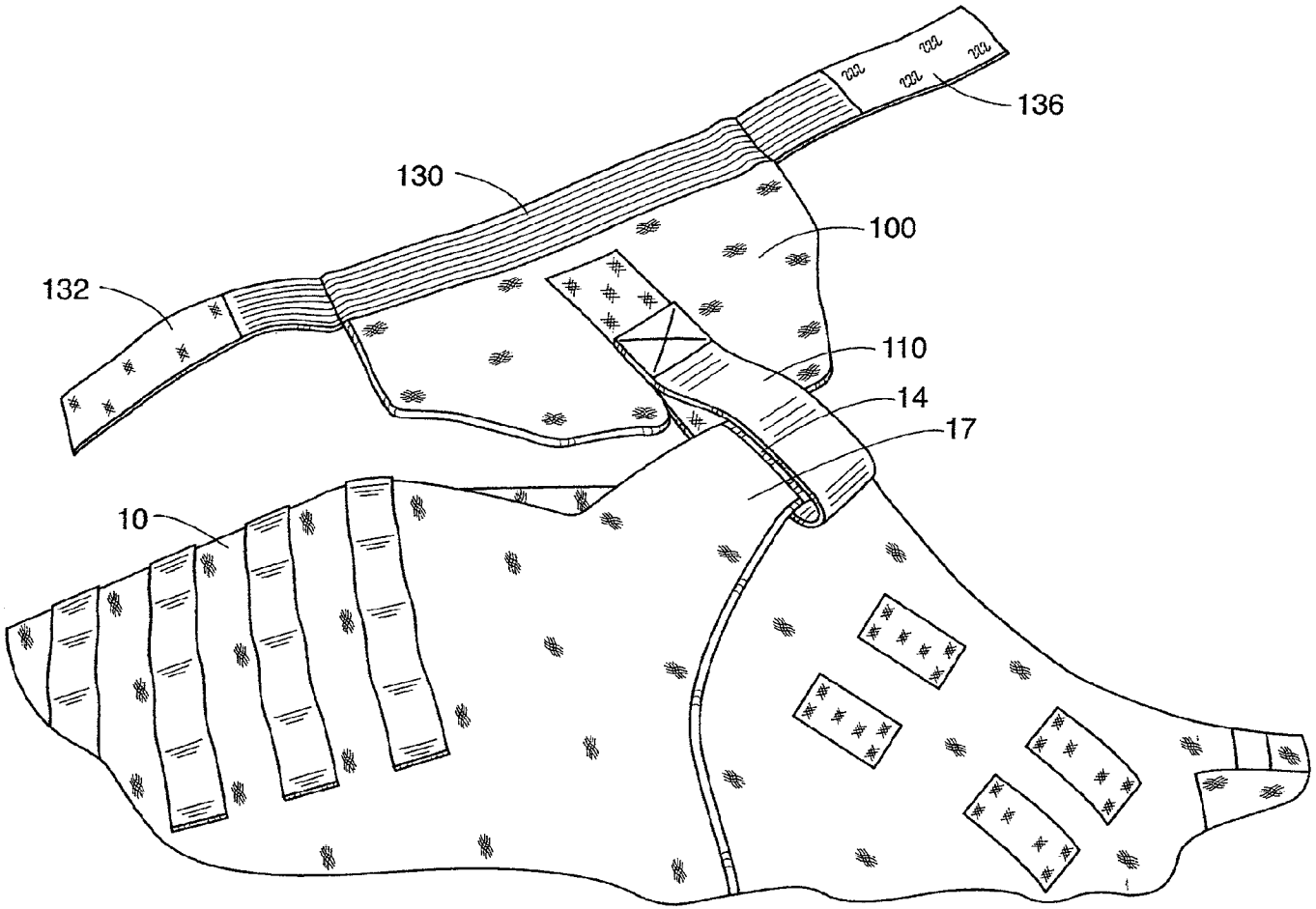

Alternatively, strap 110 can be positioned under and around the vest shoulder 17 as shown in FIG. 6B. Velcro® fasteners 18 can be used under the shoulder section of the vest to help position and secure the strap 110, before the strap 110 is looped around the shoulder portion 17 of the vest 10 as shown in FIG. 6B.

The securing strap 130 can also be positioned upon the deltoid panel to allow for placement around the arm nearer the bicep and elbow, and hence fitted to the desired arm girth. The deltoid panel should be large enough to cover a substantial portion of the deltoid, but also should be capable of securing around the arm snugly to avoid snagging on environmental objects while the wearer is in close quarters.

Although other fastening means can be used, a preferred embodiment shows again the use of hook and loop fasteners, e.g., Velcro®, to provide hooks 136 and pile 132 to accomplish fastening and sizing. Preferably, the deltoid panel weighs approximately 5 pounds or less. Alternatively, securing snaps (not shown) can be used to attach strap 110 to mating snaps on the shoulder portion of the vest. The deltoid panel 100 can be made of level II Kevlar, or any other suitable body armor material.

Figure 3:
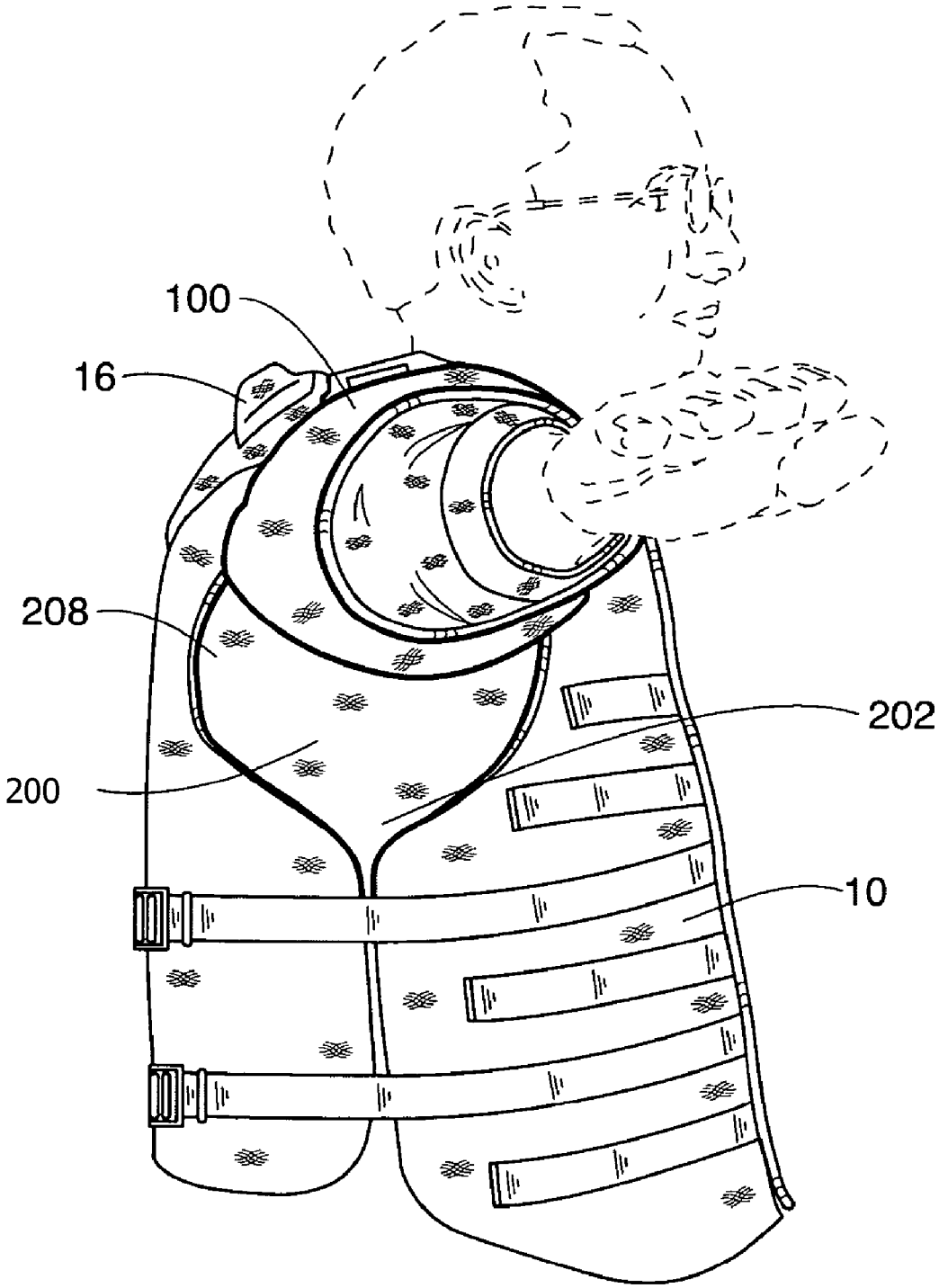
FIG. 3 shows a side view of a body armor.

As shown in FIGS. 1, 3, 5 and 6A, an axillary panel 200 protects the axillary and flank regions by, in one embodiment, underlapping an area of the vest 10. The axillary panel 200 can be secured to the inside shoulder of the vest 10 through any suitable connector, and worn under the arm. In a preferred embodiment, the axillary panel 200 can be secured to the vest using bands 210. Bands 210 can attach to interior vest loops 24, as shown in FIG. 6. Hooks 212 and piles 216 can allow the bands to pass through the loops 24, and attach upon the piles 216 on the panel for a secure fit. The bands can be adjustable in length by having long straps 210, large surface area hook portions 212 and large surface area pile portions 216. The axillary panel 200 can be made of Type IIIa Kevlar panel or other suitable protective armor. At the upper portion 215 of the axillary panel, the panel is shaped in an arcuate fashion in order to fit under the arm of the wearer, and provide some degree of both axillary 202 and flank 208 protection, as shown in FIG. 3.

Figure 7:
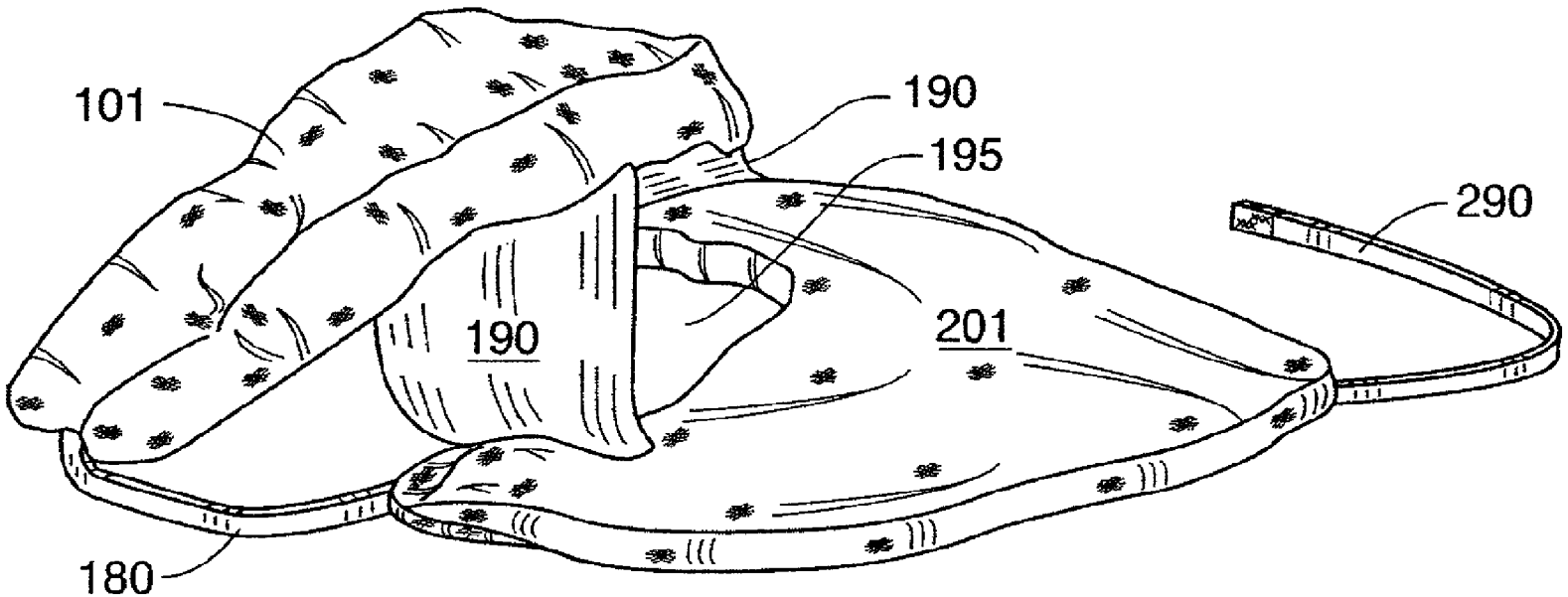
FIG. 7 shows an embodiment of a deltoid panel attached to an axillary panel.

FIG. 7 illustrates another embodiment of this invention whereby a deltoid panel 101 and axillary panel 201 appear in modified shapes and are connected to one another by use, for example, of an adjustable supporting strap 180 and strips 190, all of which can be elastic. A retaining strap 290 attaches the axillary panel 200 to the vest 10 to an interior loop (not shown). The wearer's arm slips through opening 195, allowing the deltoid panel to sit atop the shoulder, and axillary panel 201 to cover the underarm and flank regions.

During use, the axillary panel fits under the vest 10, and helps protect the underarm 202 and flank 208 regions of the wearer. In a preferred embodiment, the axillary protector 200 underlaps the vest 10 to ensure a good fit and avoid snagging the exposed panel on objects. Nevertheless, the benefits of this invention also will result if the panel overlaps the vest 10. In use, the axillary panel protects the wearer's axillary regions when his or her arms are approximately horizontal as shown in FIG. 3 raised or lifted upwards. These are common positions, for example, for a turret gunner when in the travel position and for a driver.

In another preferred embodiment, the axillary panel and/or the deltoid panel can be integral to the vest, but expandable in such a way that the coverage area for the axillary or deltoid areas are covered by use, for example, of an accordion or pleated panel that is part of the vest itself.

This invention offers mobility, and universal fit. The invention also is simple to demonstrate, and easily is removed and attached by soldiers in the field to either their right or left sides. If preferred, multiple sets can be used on both arms and shoulders. The invention does not encumber the user from engaging in a firing position, and other combat ready positions and maneuvers required in the field. It is lightweight, weighing approximately 5 pounds per panel in a preferred embodiment. The panels could be made in any suitable colors required by the usage, such as desert or woodland camouflage patterns.

Many personnel can benefit from the added protection provided by this invention. Drivers and passengers (included mounted troops) of armored and unarmored vehicles can benefit from these improvements to body armor. Turret gunners in armored and unarmored vehicles will appreciate the added protection. Occupants of boats, helicopters, tanks, light armor vehicles, and even dismounted troops will benefit from this invention. Non-military personnel, including contract personnel, law enforcement, corrections officers, tactical and private security forces also will benefit from the protection offered by this invention. Further usages include explosive ordinance disposal, athletic activities, and animal training and detaining.

During the development and testing of this invention in Iraq, the axillary panel successfully stopped a fragment from entering a wearer's chest cavity. This wearer was in the gunner position on a Light-Medium Tactical Vehicle (LMTV). Upon detonation of an IED placed by hostile forces, the vehicle cab sustained major damage. The gunner was wearing the standard issue Interceptor Body Armor vest, augmented by the axillary panel. Approximately a 1 inch metal shrapnel was stopped by the axillary panel, after the shrapnel penetrated an existing layer of the Interceptor vest. A fragment of this size is sufficient to sever major arteries in and around the heart and lungs, causing permanent injury and possibly death. The gunner was able to avoid serious injury and possible death, and returned to active duty following the incident.

The panels described herein can be comprised of an outer shell layer that enclose an insert containing one or more sheets of ballistic resistant materials, as are well known in the art. The materials comprising the outer layer and ballistic sheets can be of any suitable materials given the desired usage conditions and environments. Additional hooks, loops and reflectors can be added as desired.

While preferred embodiments of the present invention have been described above, it is to be understood that any and all equivalent realizations of the present invention are included within the scope and spirit thereof. Thus, the embodiments depicted are presented by way of example only and are not intended as limitations upon the present invention. While particular embodiments of the invention have been described and shown, it will be understood by those of ordinary skill in this art that the present invention is not limited thereto since many modifications can be made. Therefore, it is contemplated that any and all such embodiments are included in the present invention as may fall within the literal or equivalent scope of the appended claims.

We claim:

1. A body armor vest system, comprising:

a. a vest having at least two arm openings for a wearer's arms;

b. at least one axillary panel having an axillary region coverage area, the at least one axillary panel being made of ballistic material that is capable of impeding the penetration of at least one foreign object;

c. the at least one axillary panel remains substantially proximate to the wearer's axillary region and substantially parallel to a wearer's torso when the wearer's arm is raised;

d. the at least one axillary panel substantially covering at least a portion of at least one of the at least two arm openings and not covering the underside of the wearer's arm, the at least one axillary panel being removably attached to the vest; and wherein the at least one axillary panel provides greater protection to the wearer than that provided by the vest without the at least one axillary panel.

2. The body armor vest system of claim 1 further comprising:

a. a deltoid portion having a coverage area;

b. the deltoid portion being made of material that is capable of impeding the penetration of at least one foreign object; and whereby the deltoid coverage area provides greater protection to a deltoid area of a wearer than that provided by the vest without the deltoid portion.

3. The body armor accessory of claim 2 whereby the deltoid portion is removably attached to the wearer and the vest.

4. The body armor accessory of claim 2 whereby the deltoid portion is configured to allow the deltoid portion to secure at least partially to the wearer.

5. The body armor vest system of claim 1, wherein the at least one axillary panel has an upper arcuate portion.

6. The body armor vest system of claim 1, further comprising at least one connector capable of attaching the at least one axillary panel to the vest.

7. The body armor vest system of claim 6, whereby the at least one connector is a band capable of lengthwise adjustment so that the at least one axillary panel can be adjusted vertically along the wearer's torso.

8. The body armor vest system of claim 1, wherein the at least one axillary panel covers at least a portion of the armpit of the wearer, the panel remaining substantially stationary as the wearer's arm is raised.

9. The body armor vest system of claim 1, wherein the at least one axillary panel also covers a portion of the flank of the wearer.

10. A body armor vest system, comprising:

a. a vest having a back, a front and two arm openings formed by the front and back of the vest;

b. at least one axillary panel having an axillary region coverage area, the at least one axillary panel being made of ballistic material that is capable of impeding the penetration of at least one foreign object;

c. the at least one axillary panel overlaps or underlaps a portion of the vest the at least one axillary panel sized to substantially cover at least a portion of at least one of the two arm openings and not covering the underside of a wearer's arm, the at least one axillary panel remaining substantially proximate to a wearer's torso and the axillary region when the wearer's arm is raised; and wherein the at least one axillary panel provides greater protection to a wearer than that provided by the vest without the at least one axillary panel.

11. The body armor vest system of claim 10, wherein the at least one axillary panel has at least one panel connector capable of attachment to the vest, the panel connector being a band extending from the at least one axillary panel.

12. The body armor vest system of claim 11, whereby the band is capable of lengthwise adjustment so that the at least one axillary panel can be adjusted vertically along the wearer's torso.

13. The body armor vest system of claim 10, further comprising:

a. a deltoid panel having a coverage area;

b. the deltoid panel being made of material that is capable of impeding the penetration of at least one foreign object; and whereby the deltoid coverage area provides greater protection to a deltoid area of the wearer than that provided by the vest without the deltoid panel.

14. The body armor vest system of claim 13, whereby the deltoid panel is removably attached to the wearer and the vest.

15. The body armor vest system of claim 10, wherein the at least one axillary panel has an upper arcuate portion.

16. The body armor vest system of claim 10, wherein the at least one axillary panel covers at least a portion of the torso of the wearer, the at least one axillary panel remaining substantially stationary as the wearer's arm is raised.

17. The body armor vest system of claim 10, wherein the at least one axillary panel also covers a portion of the flank of the wearer.

18. An accessory system for a body armor vest having two arm openings, the system comprising:

a. at least one axillary panel having an axillary region coverage area, the at least one axillary panel being made of ballistic material that is capable of impeding the penetration of at least one foreign object;

b. the at least one axillary panel being adaptable for wearing on a left or right side of a wearer and sized to substantially cover a portion of at least one of the two arm openings of the vest but not covering the underside of a wearer's arm;

c. the at least one axillary panel remains substantially proximate to the wearer's axillary region and substantially parallel to a wearer's torso when the wearer's arm is raised; and wherein the at least one axillary panel provides greater protection to the wearer than that provided by the vest without the at least one axillary panel.

19. The accessory system of claim 18, further comprising:

a. a deltoid panel having a coverage area;

b. the deltoid panel being made of material that is capable of impeding the penetration of at least one foreign object; and whereby the deltoid coverage area provides greater protection to a deltoid area of the wearer than that provided by the vest without the deltoid panel.

20. The accessory system of claim 19, whereby the deltoid panel is removably attached to the wearer and the vest.

21. The accessory system of claim 18, whereby the at least one axillary panel has at least one panel connector capable of attachment to the vest or the deltoid panel, the at least one panel connector being a band extending from the at least one axillary panel.

22. The accessory system of claim 21, whereby the at least one panel connector is a band capable of lengthwise adjustment so that the at least one axillary panel can be adjusted vertically along the wearer's torso.

23. The accessory system of claim 18, wherein the at least one axillary panel covers at least a portion of the armpit of the wearer, the at least one axillary panel remaining substantially stationary as the wearer's arm is raised.

24. The accessory system of claim 18, wherein the at least one axillary panel also covers a portion of the flank of the wearer.

25. The accessory system of claim 18, wherein the at least one axillary panel has an upper arcuate portion.

26. A body armor vest comprising:

a. a back panel, at least two side panels adjacent either side of the back panel, and two arm openings, each arm opening bordered by the back panel and one of the side panels; and b. means to protect a wearer's axillary region by covering at least a portion of at least one of the two arm openings but not covering the underside of a wearer's arm when the wearer's arm is approximately horizontal;

wherein the means to protect the wearer's axillary region provides greater protection to a wearer than that provided by the vest without the means to protect the wearer's axillary region.

27. The body armor vest of claim 26 wherein the means to protect the wearer's axillary region further protects a flank of the wearer.

28. The body armor vest of claim 26, further including a means to protect a deltoid area of the wearer.

* * * * *